US010147443B2

(12) United States Patent
Moriya et al.

(10) Patent No.: US 10,147,443 B2
(45) Date of Patent: Dec. 4, 2018

(54) MATCHING DEVICE, JUDGMENT DEVICE, AND METHOD, PROGRAM, AND RECORDING MEDIUM THEREFOR

(71) Applicants: NIPPON TELEGRAPH AND TELEPHONE CORPORATION, Chiyoda-ku (JP); The University of Tokyo, Bunkyo-ku (JP)

(72) Inventors: Takehiro Moriya, Atsugi (JP); Takahito Kawanishi, Atsugi (JP); Yutaka Kamamoto, Atsugi (JP); Noboru Harada, Atsugi (JP); Hirokazu Kameoka, Atsugi (JP); Ryosuke Sugiura, Bunkyo-ku (JP)

(73) Assignees: NIPPON TELEGRAPH AND TELEPHONE CORPORATION, Chiyoda-ku (JP); The University of Tokyo, Bunkyo-ku (JP)

( * ) Notice: Subject to any disclaimer, the term of this patent is extended or adjusted under 35 U.S.C. 154(b) by 0 days.

(21) Appl. No.: 15/562,649

(22) PCT Filed: Apr. 11, 2016

(86) PCT No.: PCT/JP2016/061683
§ 371 (c)(1),
(2) Date: Sep. 28, 2017

(87) PCT Pub. No.: WO2016/167216
PCT Pub. Date: Oct. 20, 2016

(65) Prior Publication Data

US 2018/0090155 A1 Mar. 29, 2018

(30) Foreign Application Priority Data

Apr. 13, 2015 (JP) ..... 2015-081769

(51) Int. Cl.
*G10L 25/54* (2013.01)
*G10L 25/12* (2013.01)
(Continued)

(52) U.S. Cl.
CPC ..... *G10L 25/54* (2013.01); *G10L 25/12* (2013.01); *G10L 25/18* (2013.01); *G10L 25/21* (2013.01);
(Continued)

(58) Field of Classification Search
CPC ..... G10L 25/54; G10L 25/18; H04W 4/00
(Continued)

(56) References Cited

U.S. PATENT DOCUMENTS

2015/0100144 A1* 4/2015 Lee ..... H04W 4/70 700/94

OTHER PUBLICATIONS

International Search Report dated Jun. 21, 2016, in PCT/JP2016/061683 filed Apr. 11, 2016.

(Continued)

*Primary Examiner* — Melur Ramakrishnaiah
(74) *Attorney, Agent, or Firm* — Oblon, McClelland, Maier & Neustadt, L.L.P.

(57) ABSTRACT

A matching device includes a matching unit that judges, based on a first sequence of parameters η corresponding to each of at least one time-series signal of a predetermined time length which makes up a first signal and a second sequence of the parameters η corresponding to each of at least one time-series signal of the predetermined time length which makes up a second signal, the degree of match between the first signal and the second signal and/or whether or not the first signal and the second signal match with each other.

9 Claims, 7 Drawing Sheets

(51) Int. Cl.

| | |
|---|---|
| ***G10L 25/18*** | (2013.01) |
| ***G10L 25/21*** | (2013.01) |
| ***G10L 25/51*** | (2013.01) |
| *G10L 19/032* | (2013.01) |
| *G10L 19/07* | (2013.01) |

(52) U.S. Cl.
CPC ..... *G10L 25/51* (2013.01); *G10L 19/032* (2013.01); *G10L 19/07* (2013.01)

(58) Field of Classification Search
USPC ..... 700/94; 704/500; 84/604, 462, 611, 613
See application file for complete search history.

(56) References Cited

OTHER PUBLICATIONS

Moriya, "Essential Technology for High-Compression Voice Encoding: Line Spectrum Pair (LSP)", NTT Technical Journal, 2014, pp. 58-60, and its corresponding English version, "LSP (Line Spectrum Pair); Essential Technology for High-compression Speech Coding", NTT Technical Review.

* cited by examiner

MATCHING DEVICE, JUDGMENT DEVICE, AND METHOD, PROGRAM, AND RECORDING MEDIUM THEREFOR

TECHNICAL FIELD

This invention relates to a technology to make a judgment about matching or the segment or type of a signal based on an audio signal.

BACKGROUND ART

As a parameter indicating the characteristics of a time-series signal such as an audio signal, a parameter such as LSP is known (see, for example, Non-patent Literature 1).

Since LSP consists of multiple values, there may be a case where it is difficult to use LSP directly for sound classification and segment estimation. For example, since the LSP consists of multiple values, it is not easy to perform processing based on a threshold value using LSP.

Incidentally, though not publicly known, the inventor has proposed a parameter η. This parameter η is a shape parameter that sets a probability distribution to which an object to be coded of arithmetic codes belongs in a coding system that performs arithmetic coding of the quantization value of a coefficient in a frequency domain using a linear prediction envelope such as that used in 3GPP Enhanced Voice Services (EVS), for example. The parameter η is relevant to the distribution of objects to be coded, and appropriate setting of the parameter η makes it possible to perform efficient coding and decoding.

Moreover, the parameter η can be an index indicating the characteristics of a time-series signal. Therefore, the parameter η can be used in a technology other than the above-described coding processing, for example, a speech sound-related technology such as a matching technology or a technology to judge the segment or type of a signal.

Furthermore, since the parameter η is a single value, processing based on a threshold value using the parameter η is easier than processing based on a threshold value using LSP. For this reason, the parameter η can be used easily in a speech sound-related technology such as a matching technology or a technology to judge the segment or type of a signal.

PRIOR ART LITERATURE

Non-Patent Literature

Non-patent Literature 1: Takehiro Moriya, "LSP (Line Spectrum Pair): Essential Technology for High-compression Speech Coding", NTT Technical Review, September 2014, pp. 58-60

SUMMARY OF THE INVENTION

Problems to be Solved by the Invention

However, a matching technology and a technology to judge the segment or type of a signal which use the parameter η have not been known.

An object of the present invention is to provide a matching device that performs matching by using the parameter η, a judgment device that makes a judgment about the segment or type of a signal by using the parameter η, and a method, a program, and a recording medium therefor.

Means to Solve the Problems

A matching device according to an aspect of the present invention includes, on the assumption that a parameter η is a positive number and the parameter η corresponding to a time-series signal of a predetermined time length is a shape parameter of a generalized Gaussian distribution that approximates a histogram of a whitened spectral sequence which is a sequence obtained by dividing, by a spectral envelope estimated by regarding the η-th power of the absolute value of a frequency domain sample sequence corresponding to the time-series signal as a power spectrum, the frequency domain sample sequence, a matching unit that judges, based on a first sequence of the parameters η corresponding to each of at least one time-series signal of the predetermined time length which makes up a first signal and a second sequence of the parameters η corresponding to each of at least one time-series signal of the predetermined time length which makes up a second signal, the degree of match between the first signal and the second signal and/or whether or not the first signal and the second signal match with each other.

A judgment device according to an aspect of the present invention includes, on the assumption that a parameter η is a positive number, the parameter η corresponding to a time-series signal of a predetermined time length is a shape parameter of a generalized Gaussian distribution that approximates a histogram of a whitened spectral sequence which is a sequence obtained by dividing, by a spectral envelope estimated by regarding the η-th power of the absolute value of a frequency domain sample sequence corresponding to the time-series signal as a power spectrum, the frequency domain sample sequence, and a sequence of the parameters η corresponding to each of at least one time-series signal of the predetermined time length which makes up a first signal is a first sequence, a judgment unit that judges, based on the first sequence, the segment of a signal of a predetermined type in the first signal and/or the type of the first signal.

Effects of the Invention

It is possible to perform matching or make a judgment about the segment or type of a signal by using the parameter ii.

DETAILED DESCRIPTION OF THE EMBODIMENTS

[Matching Device and Method]

An example of matching device and method will be described.

Figure 1:
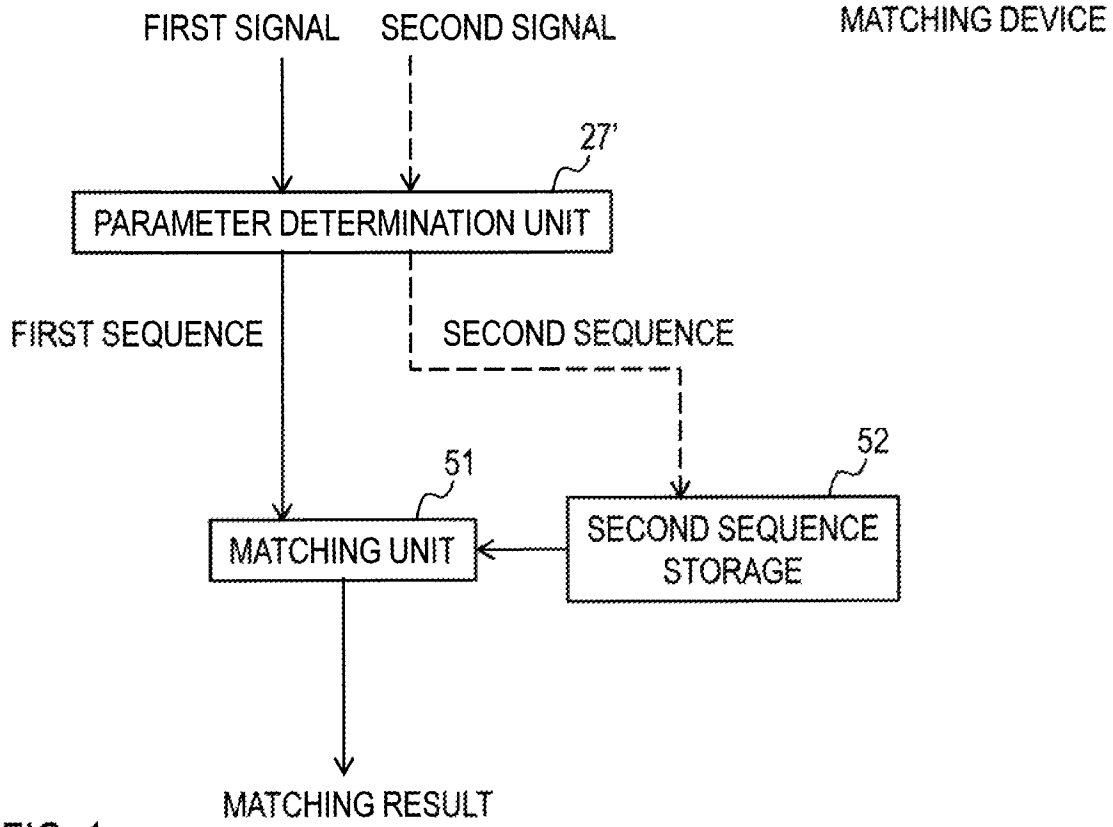
FIG. 1 is a block diagram for explaining an example of a matching device.
Figure 2:
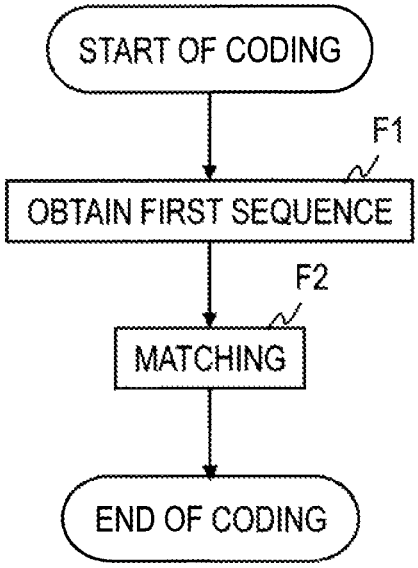
FIG. 2 is a flowchart for explaining an example of a matching method.

As depicted in FIG. 1, a matching device includes, for example, a parameter determination unit 27', a matching unit 51, and a second sequence storage 52. As a result of each unit of the matching device performing each processing depicted in FIG. 2, a matching method is implemented.

Hereinafter, each unit of the matching device will be described.

<Parameter Determination Unit 27'>

To the parameter determination unit 27', a first signal which is a time-series signal is input for each predetermined time length. An example of the first signal is an audio signal such as a speech digital signal or a sound digital signal.

The parameter determination unit 27' determines a parameter $\eta$ of the input time-series signal of the predetermined time length by processing, which will be described later, based on the input time-series signal of the predetermined time length (Step F1). As a result, the parameter determination unit 27' obtains a sequence of the parameters $\eta$ corresponding to each of at least one time-series signal of the predetermined time length which makes up the first signal. This sequence of the parameters $\eta$ corresponding to each of at least one time-series signal of the predetermined time length which makes up the first signal will be referred to as a "first sequence". As described above, the parameter determination unit 27' performs processing for each frame of the predetermined time length.

Incidentally, the at least one time-series signal of the predetermined time length which makes up the first signal may be all or part of time-series signals of the predetermined time length which make up the first signal.

The first sequence of the parameters $\eta$ determined by the parameter determination unit 27' is output to the matching unit 51.

Figure 5:
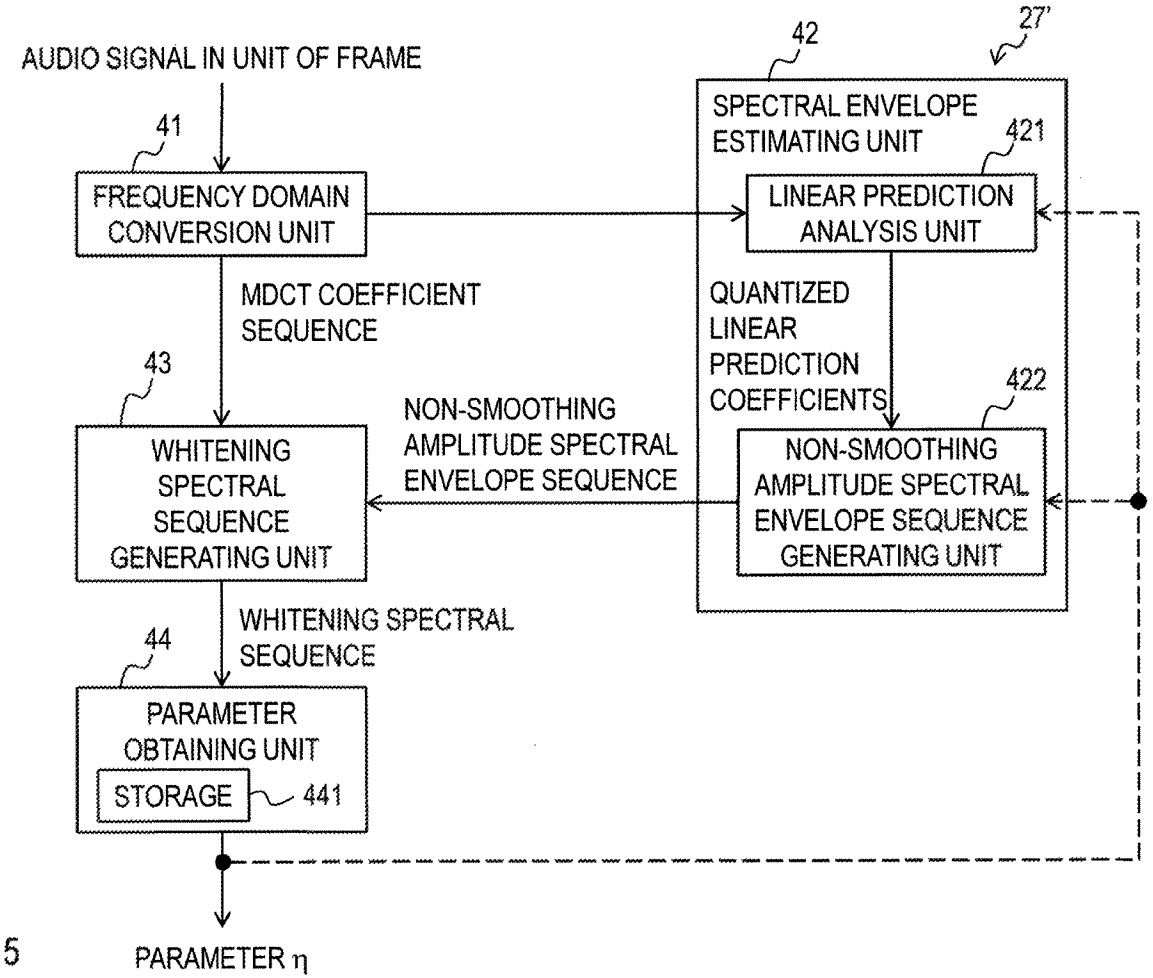
FIG. 5 is a block diagram for explaining an example of a parameter determination unit.
Figure 6:
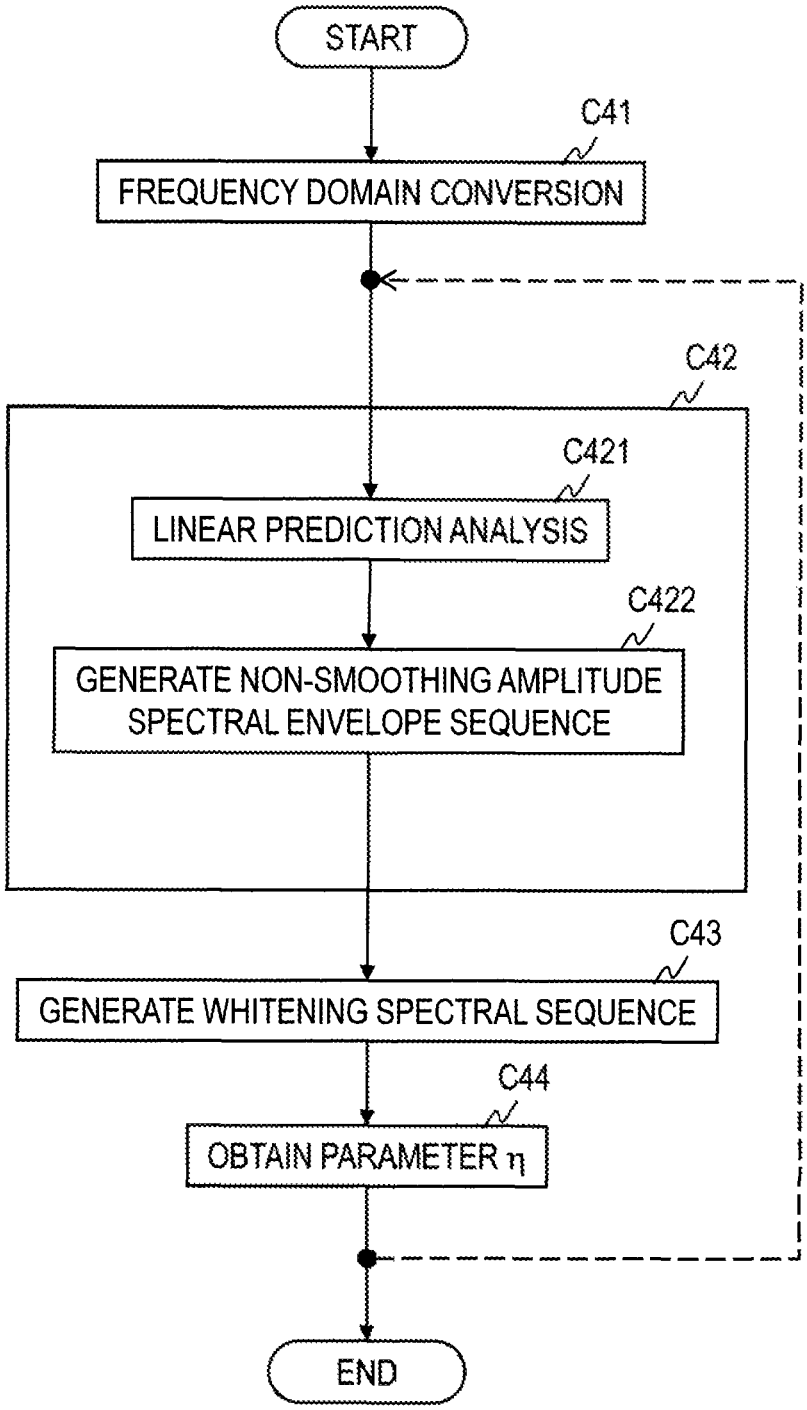
FIG. 6 is a flowchart for explaining an example of the parameter determination unit.

A configuration example of the parameter determination unit 27' is depicted in FIG. 5. As depicted in FIG. 5, the parameter determination unit 27' includes, for example, a frequency domain conversion unit 41, a spectral envelope estimating unit 42, a whitened spectral sequence generating unit 43, and a parameter obtaining unit 44. The spectral envelope estimating unit 42 includes, for example, a linear prediction analysis unit 421 and a non-smoothing amplitude spectral envelope sequence generating unit 422. An example of each processing of a parameter determination method implemented by this parameter determination unit 27', for example, is depicted in FIG. 6.

Hereinafter, each unit of FIG. 5 will be described.

<Frequency Domain Conversion Unit 41>

To the frequency domain conversion unit 41, a time-series signal of a predetermined time length is input.

The frequency domain conversion unit 41 converts an audio signal in the time domain, which is the input time-series signal of the predetermined time length, into an MDCT coefficient sequence X(0), X(1), . . . , X(N−1) at point N in the frequency domain in the unit of frame of the predetermined time length. N is a positive integer.

The obtained MDCT coefficient sequence X(0), X(1), . . . , X(N−1) is output to the spectral envelope estimating unit 42 and the whitened spectral sequence generating unit 43.

Unless otherwise specified, the subsequent processing is assumed to be performed in the unit of frame.

In this manner, the frequency domain conversion unit 41 obtains a frequency domain sample sequence, which is, for example, an MDCT coefficient sequence, corresponding to the time-series signal of the predetermined time length (Step C41).

<Spectral Envelope Estimating Unit 42>

To the spectral envelope estimating unit 42, the MDCT coefficient sequence X(0), X(1), . . . , X(N−1) obtained by the frequency domain conversion unit 41 is input.

The spectral envelope estimating unit 42 estimates, based on a parameter $\eta_0$ that is set by a predetermined method, a spectral envelope using the $\eta_0$-th power of the absolute value of the frequency domain sample sequence corresponding to the time-series signal as a power spectrum (Step C42).

The estimated spectral envelope is output to the whitened spectral sequence generating unit 43.

The spectral envelope estimating unit 42 estimates a spectral envelope by generating a non-smoothing amplitude spectral envelope sequence by, for example, processing of the linear prediction analysis unit 421 and the non-smoothing amplitude spectral envelope sequence generating unit 422, which will be described below.

The parameter $\eta_0$ is assumed to be set by the predetermined method. For example, $\eta_0$ is assumed to be a predetermined number greater than 0. For instance, it is assumed that $\eta_0=1$ holds. Moreover, $\eta$ obtained in a frame before a frame in which the parameter $\eta$ is being currently obtained may be used. A frame before a frame (hereinafter referred to as a current frame) in which the parameter $\eta$ is being currently obtained is, for example, a frame which is a frame before the current frame and near the current frame. A frame near the current frame is, for example, a frame immediately before the current frame.

<Linear Prediction Analysis Unit 421>

To the linear prediction analysis unit 421, the MDCT coefficient sequence X(0), X(1), . . . , X(N−1) obtained by the frequency domain conversion unit 41 is input.

The linear prediction analysis unit 421 generates linear prediction coefficients $\beta_1, \beta_2, \ldots, \beta_p$ by performing a linear prediction analysis on ~R(0), ~R(1), . . . , ~R(N−1), which are explicitly defined by the following expression (C1), by using the MDCT coefficient sequence X(0), X(1), . . . , X(N−1) and generates a linear prediction coefficient code and quantized linear prediction coefficients $\hat{\beta}_1, \hat{\beta}_2, \ldots, \hat{\beta}_p$, which are quantized linear prediction coefficients corresponding to the linear prediction coefficient code, by coding the generated linear prediction coefficients $\beta_1, \beta_2, \ldots, \beta_p$.

$$\tilde{R}(k) = \sum_{n=0}^{N-1} |X(n)|^{\eta_0} \exp\left(-j\frac{2\pi kn}{N}\right),\ k = 0, 1, \ldots, N-1 \tag{C1}$$

The generated quantized linear prediction coefficients $\hat{\beta}_1, \hat{\beta}_2, \ldots, \hat{\beta}_p$ are output to the non-smoothing amplitude spectral envelope sequence generating unit 422.

Specifically, the linear prediction analysis unit 421 first obtains a pseudo correlation function signal sequence ~R(0), ~R(1), . . . , ~R(N−1) which is a signal sequence in the time domain corresponding to the $\eta_0$-th power of the absolute value of the MDCT coefficient sequence X(0), X(1), . . . , X(N−1) by performing a calculation corresponding to an inverse Fourier transform regarding the $\eta_0$-th power of the absolute value of the MDCT coefficient sequence X(0), X(1), . . . , X(N−1) as a power spectrum, that is, a calculation of the expression (C1). Then, the linear prediction analysis unit 421 generates linear prediction coefficients $\beta_1, \beta_2, \ldots, \beta_p$ by performing a linear prediction analysis by using the pseudo correlation function signal sequence ~R(0), ~R(1), . . . , ~R(N−1) thus obtained. Then, the linear prediction analysis unit 421 obtains a linear prediction coefficient code and quantized linear prediction coefficients $\hat{\beta}_1, \hat{\beta}_2, \ldots, \hat{\beta}_p$ corresponding to the linear prediction coefficient code by coding the generated linear prediction coefficients $\beta_1, \beta_2, \ldots, \beta_p$.

The linear prediction coefficients $\beta_1, \beta_2, \ldots, \beta_p$ are linear prediction coefficients corresponding to a signal in the time domain when the $\eta_0$-th power of the absolute value of the MDCT coefficient sequence X(0), X(1), . . . , X(N−1) is regarded as a power spectrum.

Generation of the linear prediction coefficient code by the linear prediction analysis unit 421 is performed by the existing coding technology, for example. The existing coding technology is, for example, a coding technology that uses a code corresponding to the linear prediction coefficient itself as a linear prediction coefficient code, a coding technology that converts the linear prediction coefficient into an LSP parameter and uses a code corresponding to the LSP parameter as a linear prediction coefficient code, or a coding technology that converts the linear prediction coefficient into a PARCOR coefficient and uses a code corresponding to the PARCOR coefficient as a linear prediction coefficient code.

In this manner, the linear prediction analysis unit 421 generates linear prediction coefficients by performing a linear prediction analysis by using the pseudo correlation function signal sequence which is obtained by performing an inverse Fourier transform regarding the $\eta_0$-th power of the absolute value of the frequency domain sample sequence which is an MDCT coefficient sequence, for example, as a power spectrum (Step C421).

<Non-Smoothing Amplitude Spectral Envelope Sequence Generating Unit 422>

To the non-smoothing amplitude spectral envelope sequence generating unit 422, the quantized linear prediction coefficients $\hat{\beta}_1, \hat{\beta}_2, \ldots, \hat{\beta}_p$ generated by the linear prediction analysis unit 421 are input.

The non-smoothing amplitude spectral envelope sequence generating unit 422 generates a non-smoothing amplitude spectral envelope sequence $\hat{H}(0), \hat{H}(1), \ldots, \hat{H}(N-1)$ which is a sequence of amplitude spectral envelopes corresponding to the quantized linear prediction coefficients $\hat{\beta}_1, \hat{\beta}_2, \ldots, \hat{\beta}_p$.

The generated non-smoothing amplitude spectral envelope sequence $\hat{H}(0), \hat{H}(1), \ldots, \hat{H}(N-1)$ is output to the whitened spectral sequence generating unit 43.

The non-smoothing amplitude spectral envelope sequence generating unit 422 generates a non-smoothing amplitude spectral envelope sequence $\hat{H}(0), \hat{H}(1), \ldots, \hat{H}(N-1)$ which is explicitly defined by an expression (C2) as the non-smoothing amplitude spectral envelope sequence $\hat{H}(0), \hat{H}(1), \ldots, \hat{H}(N-1)$ by using the quantized linear prediction coefficients $\hat{\beta}_1, \hat{\beta}_2, \ldots, \hat{\beta}_p$.

$$\hat{H}(k) = \left( \frac{1}{2\pi} \frac{1}{\left| 1 + \sum_{n=1}^{P} \hat{\beta}_n \exp(-j2\pi kn/N) \right|^2} \right)^{1/\eta_0} \tag{C2}$$

In this manner, the non-smoothing amplitude spectral envelope sequence generating unit 422 estimates a spectral envelope by obtaining a non-smoothing amplitude spectral envelope sequence, which is a sequence obtained by raising a sequence of amplitude spectral envelopes corresponding to a pseudo correlation function signal sequence to the $1/\eta_0$-th power, based on the coefficients, which can be converted into linear prediction coefficients, generated by the linear prediction analysis unit 421 (Step C422).

Incidentally, the non-smoothing amplitude spectral envelope sequence generating unit 422 may obtain the non-smoothing amplitude spectral envelope sequence $\hat{H}(0), \hat{H}(1), \ldots, \hat{H}(N-1)$ by using the linear prediction coefficients $\beta_1, \beta_2, \ldots, \beta_p$ generated by the linear prediction analysis unit 421 in place of the quantized linear prediction coefficients $\hat{\beta}_1, \hat{\beta}_2, \ldots, \hat{\beta}_p$. In this case, the linear prediction analysis unit 421 does not have to perform processing to obtain the quantized linear prediction coefficients $\hat{\beta}_1, \hat{\beta}_2, \ldots, \hat{\beta}_p$.

<Whitened Spectral Sequence Generating Unit 43>

To the whitened spectral sequence generating unit 43, the MDCT coefficient sequence X(0), X(1), . . . , X(N−1) obtained by the frequency domain conversion unit 41 and the non-smoothing amplitude spectral envelope sequence $\hat{H}(0), \hat{H}(1), \ldots, \hat{H}(N-1)$ generated by the non-smoothing amplitude spectral envelope sequence generating unit 422 are input.

The whitened spectral sequence generating unit 43 generates a whitened spectral sequence $X_W(0), X_W(1), \ldots, X_W(N-1)$ by dividing each coefficient of the MDCT coefficient sequence X(0), X(1), . . . , X(N−1) by each value of the non-smoothing amplitude spectral envelope sequence $\hat{H}(0), \hat{H}(1), \ldots, \hat{H}(N-1)$ corresponding thereto.

The generated whitened spectral sequence $X_W(0), X_W(1), \ldots, X_W(N-1)$ is output to the parameter obtaining unit 44.

The whitened spectral sequence generating unit 43 generates each value $X_W(k)$ of the whitened spectral sequence $X_W(0), X_W(1), \ldots, X_W(N-1)$ by dividing each coefficient X(k) of the MDCT coefficient sequence X(0), X(1), . . . , X(N−1) by each value $\hat{H}(k)$ of the non-smoothing amplitude spectral envelope sequence $\hat{H}(0), \hat{H}(1), \ldots, \hat{H}(N-1)$ on the assumption of k=0, 1, . . . , N−1, for example. That is, $X_W(k)=X(k)/\hat{H}(k)$ holds on the assumption of k=0, 1, . . . , N−1.

In this manner, the whitened spectral sequence generating unit 43 obtains a whitened spectral sequence which is a sequence obtained by dividing a frequency domain sample sequence, which is an MDCT coefficient sequence, for example, by a spectral envelope which is a non-smoothing amplitude spectral envelope sequence, for example (Step C43).

<Parameter Obtaining Unit 44>

To the parameter obtaining unit 44, the whitened spectral sequence $X_W(0), X_W(1), \ldots, X_W(N-1)$ generated by the whitened spectral sequence generating unit 43 is input.

The parameter obtaining unit 44 obtains the parameter $\eta$ by which a generalized Gaussian distribution whose shape parameter is the parameter $\eta$ approximates a histogram of the whitened spectral sequence $X_W(0), X_W(1), \ldots, X_W(N-1)$ (Step C44). In other words, the parameter obtaining unit 44 determines the parameter $\eta$ by which a generalized Gaussian distribution whose shape parameter is the parameter $\eta$ becomes close to the distribution of a histogram of the whitened spectral sequence $X_W(0), X_W(1), \ldots, X_W(N-1)$.

The generalized Gaussian distribution whose shape parameter is the parameter $\eta$ is explicitly defined as follows, for example. $\Gamma$ is a gamma function.

$$f_{GG}(X \mid \phi, \eta) = \frac{A(\eta)}{\phi}\exp\left(-\left|B(\eta)\frac{X}{\phi}\right|^{\eta}\right),$$

$$A(\eta) = \frac{\eta B(\eta)}{2\Gamma(1/\eta)},\ B(\eta) = \sqrt{\frac{\Gamma(3/\eta)}{\Gamma(1/\eta)}},$$

$$\Gamma(x) = \int_0^{\infty} e^{-t}t^{x-1}dt$$

Figure 7:
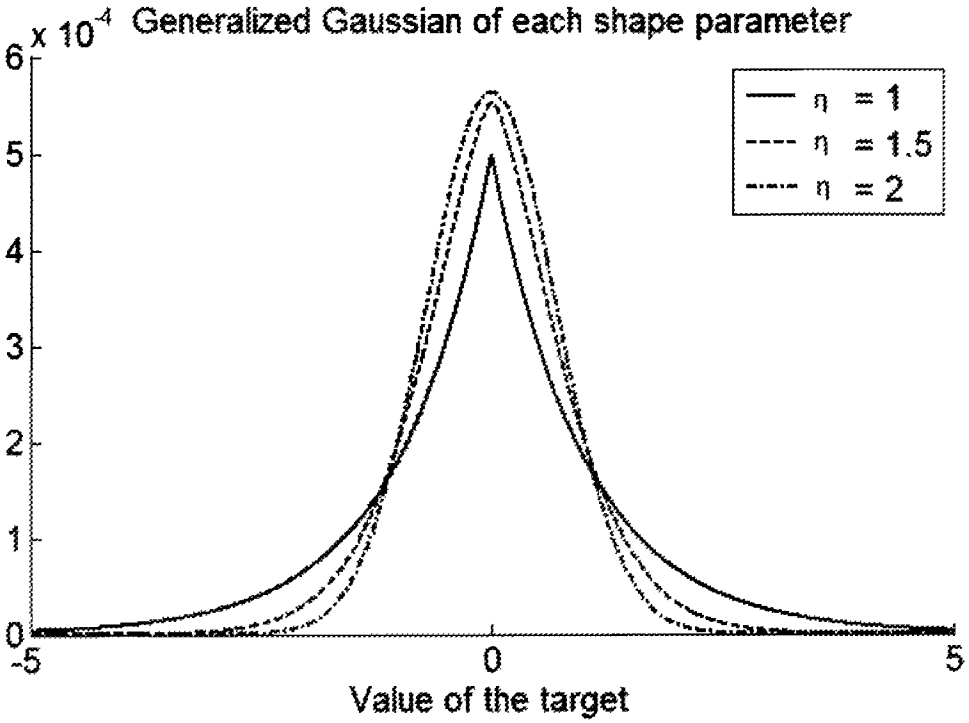
FIG. 7 is a diagram for explaining a generalized Gaussian distribution.

As depicted in FIG. 7, the generalized Gaussian distribution can express various distributions by changing η which is a shape parameter, such as expressing a Laplace distribution when η=1 holds and a Gaussian distribution when η=2 holds. η is a predetermined number greater than 0. η may be a predetermined number, other than 2, which is greater than 0. Specifically, η may be a predetermined positive number smaller than 2. ϕ is a parameter corresponding to variance.

Here, η is obtained by the parameter obtaining unit 44 is explicitly defined by the following expression (C3), for example. $F^{-1}$ is an inverse function of a function F. This expression is derived by a so-called method of moment.

$$\eta = F^{-1}\left(\frac{m_1}{\sqrt{m_2}}\right) \tag{C3}$$

$$F(\eta) = \frac{\Gamma(2/\eta)}{\sqrt{\Gamma(1/\eta)\Gamma(3/\eta)}}$$

$$m_1 = \frac{1}{N}\sum_{k=0}^{N-1}|X_W(k)|,$$

$$m_2 = \frac{1}{N}\sum_{k=0}^{N-1}|X_W(k)|^2$$

If the inverse function $F^{-1}$ is explicitly defined, the parameter obtaining unit 44 can obtain the parameter t by calculating an output value which is obtained when the value of $m_1/((m_2)^{1/2})$ is input to the explicitly defined inverse function $F^{-1}$.

If the inverse function $F^{-1}$ is not explicitly defined, the parameter obtaining unit 44 may obtain the parameter η by, for example, a first method or a second method, which will be described below, to calculate the value of η which is explicitly defined by the expression (C3).

The first method for obtaining the parameter η will be described. In the first method, the parameter obtaining unit 44 calculates $m_1/((m_2)^{1/2})$ based on the whitened spectral sequence and obtains η corresponding to F(η) closest to the calculated $m_1/((m_2)^{1/2})$ by referring to a plurality of different pairs of η and F(η) corresponding to η which were prepared in advance.

A plurality of different pairs of η and F(η) corresponding to η which were prepared in advance are stored in advance in a storage 441 of the parameter obtaining unit 44. The parameter obtaining unit 44 finds F(η) closest to the calculated $m_1/((m_2)^{1/2})$ by referring to the storage 441, reads η corresponding to F(η) thus found from the storage 441, and outputs η.

F(η) closest to the calculated $m_1/((m_2)^{1/2})$ is F(η) with the smallest absolute value of a difference from the calculated $m_1/((m_2)^{1/2})$.

The second method for obtaining the parameter η will be described. In the second method, based on the assumption that an approximate curve function of the inverse function $F^{-1}$ is $\sim F^{-1}$ expressed by the following expression (C3'), for example, the parameter obtaining unit 44 calculates $m_1/((m_2)^{1/2})$ based on the whitened spectral sequence and obtains η by calculating an output value which is obtained when the calculated $m_1/((m_2)^{1/2})$ is input to the approximate curve function $\sim F^{-1}$. This approximate curve function $\sim F^{-1}$ only has to be a monotonically increasing function whose output is a positive value in a domain which is used.

$$\eta = \tilde{F}^{-1}\left(\frac{m_1}{\sqrt{m_2}}\right) \tag{C3'}$$

$$\tilde{F}^{-1}(x) = \frac{0.2718}{0.7697 - x} - 0.1247$$

Incidentally, η which is obtained by the parameter obtaining unit 44 may be explicitly defined not by the expression (C3), but by an expression, such as an expression (C3"), which is obtained by generalizing the expression (C3) by using previously set positive integers q1 and q2 (q1<q2).

$$\eta = F'^{-1}\left(\frac{m_{q_1}}{(m_{q_2})^{q_1/q_2}}\right) \tag{C3''}$$

$$F'(\eta) = \frac{\Gamma((q_1+1)/\eta)}{(\Gamma(1/\eta))^{1-q_1/q_2}(\Gamma((q_2+1)/\eta))^{q_1/q_2}}$$

$$m_{q_1} = \frac{1}{N}\sum_{k=0}^{N-1}|X_W(k)|^{q_1},\ m_{q_2} = \frac{1}{N}\sum_{k=0}^{N-1}|X_W(k)|^{q_2}$$

Incidentally, even when η is explicitly defined by the expression (C3"), η can be obtained also by a method similar to the method which is adopted when η is explicitly defined by the expression (C3). That is, after calculating, based on the whitened spectral sequence, a value $m_{q1}/((m_{q2})^{q1/q2})$ based on $m_{q1}$ which is the q1-order moment thereof and $m_{q2}$ which is the q2-order moment thereof, the parameter obtaining unit 44 can obtain η corresponding to F'(η) closest to the calculated $m_{q1}/((m_{q2})^{q1/q2})$ by referring to a plurality of different pairs of η and F'(η) corresponding to η which were prepared in advance or determine η by calculating an output value which is obtained when the calculated $m_{q1}/((m_{q2})^{q1/q2})$ is input to the approximate curve function $\sim F'^{-1}$ on the assumption that an approximate curve function of an inverse function $F'^{-1}$ is $\sim F'^{-1}$ as in the above-described first and second methods, for example.

As described above, η can also be said to be a value based on the two different types of moment $m_{q1}$ and $m_{q2}$ of different orders. For instance, η may be obtained based on the value of the ratio between, of the two different types of moment $m_{q1}$ and $m_{q2}$ of different orders, the value of the moment of a lower order or a value based on that value (hereinafter referred to as the former) and the value of the moment of a higher order or a value based on that value (hereinafter referred to as the latter), a value based on the value of this ratio, or a value which is obtained by dividing the former by the latter. A value based on the moment is, for example, $m^Q$ on the assumption that the moment is m and Q is a predetermined real number. Moreover, η may be obtained by inputting these values to an approximate curve function $\sim F'^{-1}$. As in the case described above, this approximate curve function $\sim F'^{-1}$ only has to be a monotonically increasing function whose output is a positive value in a domain which is used.

The parameter determination unit 27' may obtain the parameter $\eta$ by loop processing. That is, the parameter determination unit 27' may further perform one or more operations of processing of the spectral envelope estimating unit 42, the whitened spectral sequence generating unit 43, and the parameter obtaining unit 44 with the parameter $\eta$ which is obtained by the parameter obtaining unit 44 being the parameter $\eta_0$ which is set by the predetermined method.

In this case, for example, as indicated by a dashed line in FIG. 5, the parameter $\eta$ obtained by the parameter obtaining unit 44 is output to the spectral envelope estimating unit 42. The spectral envelope estimating unit 42 estimates a spectral envelope by performing processing similar to the above-described processing by using $\eta$ obtained by the parameter obtaining unit 44 as the parameter $\eta_0$. The whitened spectral sequence generating unit 43 generates a whitened spectral sequence by performing processing similar to the above-described processing based on the newly estimated spectral envelope. The parameter obtaining unit 44 obtains the parameter $\eta$ by performing processing similar to the above-described processing based on the newly generated whitened spectral sequence.

For example, the processing of the spectral envelope estimating unit 42, the whitened spectral sequence generating unit 43, and the parameter obtaining unit 44 may be further performed $\tau$ time which is a predetermined number of times. $\tau$ is a predetermined positive integer and $\tau=1$ or $\tau=2$ holds, for example.

Moreover, the spectral envelope estimating unit 42 may repeat the processing of the spectral envelope estimating unit 42, the whitened spectral sequence generating unit 43, and the parameter obtaining unit 44 until the absolute value of a difference between the parameter $\eta$ obtained this time and the parameter $\eta$ obtained last time becomes smaller than or equal to a predetermined threshold value.

<Second Sequence Storage 52>

In the second sequence storage 52, a second sequence which is a sequence of the parameters $\eta$ corresponding to each of at least one time-series signal of the predetermined time length which makes up a second signal is stored.

The second signal is an audio signal, such as a speech digital signal or a sound digital signal, whose match for the first signal is to be checked.

The second sequence is, for example, obtained by the parameter determination unit 27' and stored in the second sequence storage 52. That is, each of the at least one time-series signal of the predetermined time length which makes up the second signal is input to the parameter determination unit 27', and the parameter determination unit 27' may obtain the second sequence by processing similar to the processing by which the parameter determination unit 27' obtains the first sequence and make the second sequence storage 52 store the second sequence.

Incidentally, the at least one time-series signal of the predetermined time length which makes up the second signal may be all or part of time-series signals of the predetermined time length which make up the second signal.

When the matching unit 51 makes a judgment, which will be described later, by treating each of a plurality of signals as the second signal, the second sequence corresponding to each of the plurality of signals is assumed to be stored in the second sequence storage 52.

Incidentally, the second sequence obtained by the parameter determination unit 27' may be input directly to the matching unit 51 without the second sequence storage 52. In this case, the second sequence storage 52 may not be provided in the matching device. Moreover, in this case, the parameter determination unit 27' reads each signal from an unillustrated database in which a plurality of signals (a plurality of pieces of music), for example, are stored, obtains the second sequence from the read signal, and outputs the second sequence to the matching unit 51.

<Matching Unit 51>

To the matching unit 51, the first sequence obtained by the parameter determination unit 27' and the second sequence read from, for example, the second sequence storage 52 are input.

Based on the first sequence and the second sequence, the matching unit 51 judges the degree of match between the first signal and the second signal and/or whether or not the first signal and the second signal match with each other, and outputs the judgment result (Step F2).

The first sequence is written as $(\eta_{1,1}, \eta_{1,2}, \ldots, \eta_{1,N1})$ and the second sequence is written as $(\eta_{2,1}, \eta_{2,2}, \ldots, \eta_{2,N2})$. N1 is the number of the parameters $\eta$ which make up the first sequence. N2 is the number of the parameters $\eta$ which make up the second sequence. It is assumed that $N1 \leq N2$ holds.

The degree of match between the first signal and the second signal is the degree of similarity between the first sequence and the second sequence. The degree of similarity between the first sequence and the second sequence is, for example, the distance between a sequence, which is included in the second sequence $(\eta_{2,1}, \eta_{2,2}, \ldots, \eta_{2,N2})$, closest to the first sequence $(\eta_{1,1}, \eta_{1,2}, \ldots, \eta_{1,N1})$ and the first sequence $(\eta_{1,1}, \eta_{1,2}, \ldots, \eta_{1,N1})$. It is assumed that the number of elements of the sequence, which is included in the second sequence $(\eta_{2,1}, \eta_{2,2}, \ldots, \eta_{2,N2})$, closest to the first sequence $(\eta_{1,1}, \eta_{1,2}, \ldots, \eta_{1,N1})$ and the number of elements of the first sequence $(\eta_{1,1}, \eta_{1,2}, \ldots, \eta_{1,N1})$ are the same.

The degree of similarity between the first sequence and the second sequence is explicitly defined by the following expression, for example. min is a function that outputs a minimum value. In this example, the Euclidean distance is used as the distance, but other existing distances such as the Manhattan distance or the standard deviation of errors may be used.

$$\min_{m \in \{0,1,\ldots,N2-N1\}} \left( \sum_{k=1}^{N1} (\eta_{1,k} - \eta_{2,m+k})^2 \right)^{\frac{1}{2}}$$

A sequence of representative values of the parameters $\eta$ which is obtained from the first sequence $(\eta_{1,1}, \eta_{1,2}, \ldots, \eta_{1,N1})$ is assumed to be a representative first sequence $(\eta_{1,1}^r, \eta_{1,2}^r, \ldots, \eta_{1,N1'}^r)$. Likewise, a sequence of representative values of the parameters $\eta$ which is obtained from the second sequence $(\eta_{2,1}, \eta_{2,2}, \ldots, \eta_{2,N2})$ is assumed to be a representative second sequence $(\eta_{2,1}^r, \eta_{2,2}^r, \ldots, \eta_{2,N2'}^r)$.

For instance, assume that a representative value is obtained for each c parameters $\eta$ on the assumption that c is a predetermined positive integer which is a submultiple of N1 and N2. Then, a representative value $\eta_{1,k}^r$ is a representative value of a sequence $(\eta_{1,(k-1)c+1}, \eta_{1,(k-1)c+2}, \ldots, \eta_{1,kc})$ in the first sequence on the assumption of $N1'=N1/c$ and $k=1, 2, \ldots, N1'$. Likewise, a representative value $\eta_{2,k}^r$ is a representative value of a sequence $(\eta_{2,(k-1)c+1}, \eta_{2,(k-1)c+2}, \ldots, \eta_{2,kc})$ in the second sequence.

On the assumption of $k=1, 2, \ldots, N1'$, the representative value $\eta_{1,k}^r$, is a value representing the sequence $(\eta_{1,(k-1)c+I},$ $\eta_{1,(k-1)c+2}, \ldots, \eta_{1,kc}$) in the first sequence and is, for example, a mean value, a median value, a maximum value, or a minimum value of the sequence ($\eta_{1,(k-1)c+1}$, $\eta_{1,(k-1)c+2}, \ldots, \eta_{1,kc}$). On the assumption of k=1, 2, . . . , N2', the representative value $\eta_{2,k}^{r}$ is a value representing the sequence ($\eta_{2,(k-1)c+1}$, $\eta_{2,(k-1)c+2} \ldots, \eta_{2,kc}$) in the second sequence and is, for example, a mean value, a median value, a maximum value, or a minimum value of the sequence ($\eta_{2,(k-1)c+1}$, $\eta_{2,(k-1)c+2}, \ldots, \eta_{2,kc}$).

The degree of similarity between the first sequence and the second sequence may be the distance between a sequence, which is included in the representative second sequence ($\eta_{2,1}^{r}$, $\eta_{2,2}^{r}, \ldots, \eta_{2,N2'}^{r}$), closest to the representative first sequence ($\eta_{1,1}^{r}$, $\eta_{1,2}^{r}, \ldots, \eta_{1,N1'}^{r}$) and the representative first sequence ($\eta_{1,1}^{r}$, $\eta_{1,2}^{r}, \ldots, \eta_{1,N1'}^{r}$). It is assumed that the number of elements of the sequence, which is included in the representative second sequence ($\eta_{2,1}^{r}$, $\eta_{2,2}^{r}, \ldots, \eta_{2,N2'}^{r}$), closest to the representative first sequence ($\eta_{1,1}^{r}$, $\eta_{1,2}^{r}, \ldots, \eta_{1,N1'}^{r}$) and the number of elements of the representative first sequence ($\eta_{1,1}^{r}$, $\eta_{1,2}^{r}, \ldots, \eta_{1,N1'}^{r}$) are the same.

The degree of similarity between the first sequence and the second sequence which uses the representative value is explicitly defined by the following expression, for example. min is a function that outputs a minimum value. In this example, the Euclidean distance is used as the distance, but other existing distances such as the Manhattan distance or the standard deviation of errors may be used.

$$\min_{m\in\{0,1,\ldots,N2'-N1'\}}\left(\sum_{k=1}^{N1}(\eta_{1,k}^{r}-\eta_{2,m+k}^{r})^2\right)^{\frac{1}{2}}$$

A judgment as to whether or not the first signal and the second signal match with each other can be made by, for example, comparing the degree of match between the first signal and the second signal with a predetermined threshold value. For instance, the matching unit 51 judges that the first signal and the second signal match with each other if the degree of match between the first signal and the second signal is smaller than the predetermined threshold value or smaller than or equal to the predetermined threshold value; otherwise, the matching unit 51 judges that the first signal and the second signal do not match with each other.

The matching unit 51 may make the above-described judgment by using each of a plurality of signals as the second signal. In this case, the matching unit 51 may calculate the degree of match between each of the plurality of signals and the first signal, select a signal of the plurality of signals, the signal whose calculated degree of match is the smallest, and output information on the signal whose degree of match is the smallest.

For example, assume that the second sequence and information corresponding to each of a plurality of pieces of music are stored in the second sequence storage 52 and the user desires to know which of the pieces of music corresponds to a certain tune. In this case, the user inputs an audio signal corresponding to the tune to the matching device as the first signal, which makes it possible for the matching unit 51, by obtaining to information on a piece of music whose degree of match for the audio signal corresponding to the tune is the smallest from the second sequence storage 52, to know the information on the piece of music corresponding to the tune.

Incidentally, the matching unit 51 may perform matching based on a time change first sequence ($\Delta\eta_{1,1}$, $\Delta\eta_{1,2}, \ldots, \Delta\eta_{1,N1-1}$) which is a sequence of time changes of the first sequence ($\eta_{1,1}$, $\eta_{1,2}, \ldots, \eta_{1,N1}$) and a time change second sequence ($\Delta\eta_{2,1}$, $\Delta\eta_{2,2}, \ldots, \Delta\eta_{2,N2-1}$) which is a sequence of time changes of the second sequence ($\eta_{2,1}$, $\eta_{2,2}, \ldots, \eta_{2,N2}$). Here, for example, it is assumed that $\Delta\eta_{1,k}=\eta_{1,k+1}-\eta_{1,k}$ (k=1, 2, . . . , N1−1) and $\Delta\eta_{2,k}=\eta_{2,k+1}-\eta_{2,k}$ (k=1, 2, . . . , N2−1) hold.

For instance, in the above-described matching processing using the first sequence and the second sequence, by using the time change first sequence ($\Delta\eta_{1,1}$, $\Delta\eta_{1,2}, \ldots, \Delta\eta_{1,N1-1}$) in place of the first sequence ($\eta_{1,1}$, $\eta_{1,2}, \ldots, \eta_{1,N1}$) and the time change second sequence ($\Delta\eta_{2,1}$, $\Delta\eta_{2,2}, \ldots, \Delta\eta_{2,N2-1}$) in place of the second sequence ($\eta_{2,1}$, $\eta_{2,2}, \ldots, \eta_{2,N2}$), it is possible to perform matching based on the time change first sequence and the time change second sequence.

Moreover, the matching unit 51 may perform matching by further using, in addition to the first sequence and the second sequence, the amount of sound characteristics such as an index (for example, an amplitude or energy) indicating the loudness of a sound, temporal variations in the index indicating the loudness of a sound, a spectral shape, temporal variations in the spectral shape, the interval between pitches, and a fundamental frequency. For instance, (1) the matching unit 51 may perform matching based on the first sequence and the second sequence and the index indicating the loudness of a sound. Moreover, (2) the matching unit 51 may perform matching based on the first sequence and the second sequence and the temporal variations in the index indicating the loudness of a sound of a time-series signal. Furthermore, (3) the matching unit 51 may perform matching based on the first sequence and the second sequence and the spectral shape of a time-series signal. In addition, (4) the matching unit 51 may perform matching based on the first sequence and the second sequence and the temporal variations in the spectral shape of a time-series signal. Moreover, (5) the matching unit 51 may perform matching based on the first sequence and the second sequence and the interval between pitches of a time-series signal.

Furthermore, the matching unit 51 may perform matching by using an identification technology such as support vector machine (SVM) or boosting.

Incidentally, the matching unit 51 may judge the type of each time-series signal of the predetermined time length which makes up the first signal by processing similar to processing of a judgment unit 53, which will be described later, and judge the type of each time-series signal of the predetermined time length which makes up the second signal by processing similar to processing of the judgment unit 53, which will be described later, and thereby perform matching by judging whether the judgment results thereof are the same. For instance, the matching unit 51 judges that the first signal and the second signal match with each other if the judgment result about the first signal is "speech→music→speech→music" and the judgment result about the second signal is "speech→music→speech→music".

[Judgment Device and Method]

An example of judgment device and method will be described.

Figure 3:
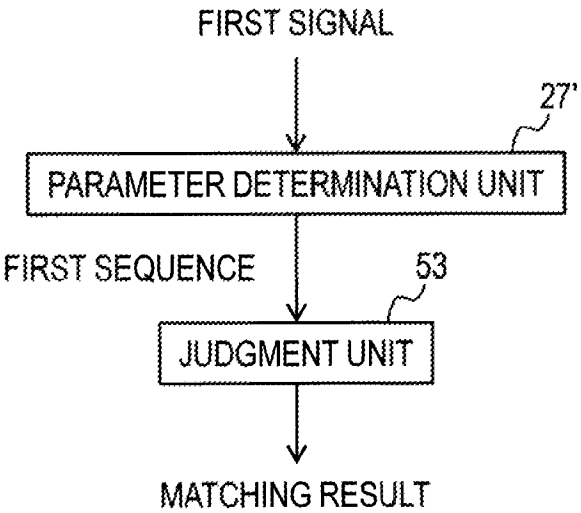
FIG. 3 is a block diagram for explaining an example of a judgment device.
Figure 4:
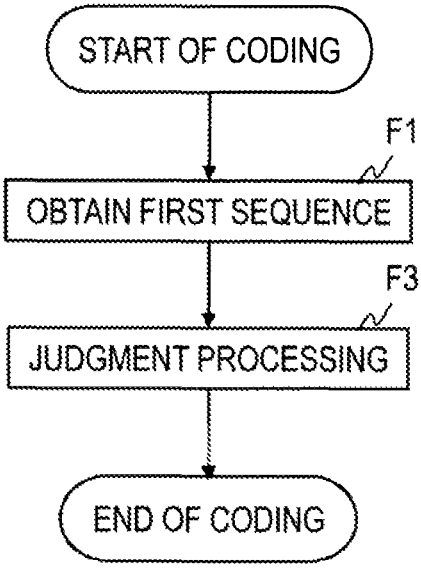
FIG. 4 is a flowchart for explaining an example of a judgment method.

The judgment device includes, as depicted in FIG. 3, a parameter determination unit 27' and a judgment unit 53, for example. As a result of each unit of the judgment device performing each processing illustrated in FIG. 4, the judgment method is implemented.

Hereinafter, each unit of the judgment device will be described.

<Parameter Determination Unit 27'>

To the parameter determination unit 27', a first signal which is a time-series signal is input for each predetermined time length. An example of the first signal is an audio signal such as a speech digital signal or a sound digital signal.

The parameter determination unit 27' determines a parameter $\eta$ of the input time-series signal of the predetermined time length by processing, which will be described later, based on the input time-series signal of the predetermined time length (Step F1). As a result, the parameter determination unit 27' obtains a sequence of the parameters $\eta$ corresponding to each of at least one time-series signal of the predetermined time length which makes up the first signal. This sequence of the parameters $\eta$ corresponding to each of at least one time-series signal of the predetermined time length which makes up the first signal will be referred to as a "first sequence". As described above, the parameter determination unit 27' performs processing for each frame of the predetermined time length.

Incidentally, the at least one time-series signal of the predetermined time length which makes up the first signal may be all or part of time-series signals of the predetermined time length which make up the first signal.

The first sequence of the parameters $\eta$ determined by the parameter determination unit 27' is output to the judgment unit 53.

Since the details of the parameter determination unit 27' are the same as those described in the [Matching device and method] section, overlapping explanations will be omitted here.

<Judgment Unit 53>

To the judgment unit 53, the first sequence determined by the parameter determination unit 27' is input.

The judgment unit 53 judges the segment of a signal of a predetermined type in the first signal and/or the type of the first signal based on the first sequence (Step F3). The signal segment of a predetermined type is, for example, a segment such as the segment of speech, the segment of music, the segment of a non-steady sound, and the segment of a steady sound.

The first sequence is written as $(\eta_{1,1}, \eta_{1,2}, \ldots, \eta_{1,N1})$. N1 is the number of the parameters $\eta$ which make up the first sequence.

A judgment about the segment of a signal of a predetermined type in the first signal can be made by, for example, comparing the parameter $\eta_{1,k}$ (k=1, 2, . . . , N1) which makes up the first sequence with a predetermined threshold value.

For instance, if the parameter $\eta_{1,k}$≥the threshold value holds, the judgment unit 53 judges that the segment of a time-series signal of the predetermined time length in the first signal, which corresponds to the parameter $\eta_{1,k}$, is the segment of a non-steady sound (such as speech or a pause).

Moreover, if the threshold value>the parameter $\eta_{1,k}$ holds, the judgment unit 53 judges that the segment of a time-series signal of the predetermined time length in the first signal, which corresponds to the parameter $\eta_{1,k}$, is the segment of a steady sound (such as music with gradual temporal variations).

Moreover, a judgment about the segment of a signal of a predetermined type in the first signal may be made by performing a comparison with a plurality of predetermined threshold values. Hereinafter, an example of a judgment using two threshold values (a first threshold value and a second threshold value) will be described. It is assumed that the first threshold value>the second threshold value holds.

For example, if the parameter $\eta_{1,k}$≥the first threshold value holds, the judgment unit 53 judges that the segment of a time-series signal of the predetermined time length in the first signal, which corresponds to the parameter $\eta_{1,k}$, is the segment of a pause.

Moreover, if the first threshold value>the parameter $\eta_{1,k}$≥the second threshold value holds, the judgment unit 53 judges that the segment of a time-series signal of the predetermined time length in the first signal, which corresponds to the parameter $\eta_{1,k}$, is the segment of a non-steady sound.

Furthermore, if the second threshold value>the parameter $\eta_{1,k}$ holds, the judgment unit 53 judges that the segment of a time-series signal of the predetermined time length in the first signal, which corresponds to the parameter $\eta_{1,k}$, is the segment of a steady sound.

A judgment about the type of the first signal can be made based on the judgment result of the type of the segment of a signal, for example. For instance, for each type of the segment of a signal on which a judgment was made, the judgment unit 53 calculates the proportion of the segment of a signal of that type in the first signal, and, if the value of the proportion of the type of the segment of a signal whose proportion is the largest is greater than or equal to a threshold value of processing or greater than the threshold value, judges that the first signal is of the type of the segment of a signal whose proportion is the largest.

A sequence of representative values of the parameters $\eta$ which is obtained from the first sequence $(\eta_{1,1}, \eta_{1,2}, \ldots, \eta_{1,N1})$ is assumed to be a representative first sequence $(\eta_{1,1}^r, \eta_{1,2}^r, \ldots, \eta_{1,N1'}^r)$. For example, assume that a representative value is obtained for each c parameters T on the assumption that c is a predetermined positive integer which is a submultiple of N1. Then, a representative value $\eta_{1,k}^r$ is a representative value of a sequence $(\eta_{1,(k-1)c+1}, \eta_{1,(k-1)c+2}, \ldots, \eta_{1,kc})$ in the first sequence on the assumption of N1'=N1/c and k=1, 2, . . . , N1'. On the assumption of k=1, 2, . . . , N1', the representative value $\eta_{1,k}^r$ is a value representing the sequence $(\eta_{1,(k-1)c+1}, \eta_{1,(k-1)c+2}, \ldots, \eta_{1,kc})$ in the first sequence and is, for example, a mean value, a median value, a maximum value, or a minimum value of the sequence $(\eta_{1,(k-1)c+1}, \eta_{1,(k-1)c+2}, \ldots, \eta_{1,kc})$.

The judgment unit 53 may judge the segment of a signal of a predetermined type in the first signal and/or the type of the first signal based on the representative first sequence $(\eta_{1,1}^r, \eta_{1,2}^r, \ldots, \eta_{1,N1'}^r)$.

For example, if the representative value $\eta_{1,k}^r$≥a first threshold value holds, the judgment unit 53 judges that the segment of a time-series signal of the predetermined time length in the first signal, which corresponds to the representative value $\eta_{1,k}^r$, is the segment of speech.

Here, the segment of a time-series signal of the predetermined time length corresponding to the representative value $\eta_{1,k}^r$ is the segment of a time-series signal of the predetermined time length corresponding to each parameter $\eta$ of the sequence $(\eta_{1,(k-1)c+1}, \eta_{1,(k-1)c+2}, \ldots, \eta_{1,kc})$ in the first sequence corresponding to the representative value $\eta_{1,k}^r$.

Moreover, if the first threshold value>the representative value $\eta_{1,k}^r$≥a second threshold value holds, the judgment unit 53 judges that the segment of a time-series signal of the predetermined time length in the first signal, which corresponds to the representative value $\eta_{1,k}^r$, is the segment of music.

Furthermore, if the second threshold value>the representative value $\eta_{1,k}^r$≥a third threshold value holds, the judgment unit 53 judges that the segment of a time-series signal of the predetermined time length in the first signal, which corresponds to the representative value $\eta_{1,k}^r$, is the segment of a non-steady sound.

In addition, if the third threshold value>the representative value $\eta_{1,k}^{r}$ holds, the judgment unit 53 judges that the segment of a time-series signal of the predetermined time length in the first signal, which corresponds to the representative value $\eta_{1,k}^{r}$, is the segment of a steady sound.

Incidentally, the judgment unit 53 may perform judgment processing based on a time change first sequence ($\Delta\eta_{1,1}$, $\Delta\eta_{1,2}$, . . . , $\Delta\eta_{1,N1-1}$) which is a sequence of time changes of the first sequence ($\eta_{1,1}$, $\eta_{1,2}$, . . . , $\eta_{1N,1}$). Here, for example, it is assumed that $\Delta\eta_{1,k}=\eta_{1,k+1}-\eta_{1,k}$ (k=1, 2, . . . , N1−1) holds.

For instance, in the above-described judgment processing using the first sequence, by using the time change first sequence ($\Delta\eta_{1,1}$, $\Delta\eta_{1,2}$, . . . , $\Delta\eta_{1,N1-1}$) in place of the first sequence ($\eta_{1,1}$, $\eta_{1,2}$, . . . , $\eta_{1,N1}$), it is possible to make a judgment based on the time change first sequence.

Moreover, the judgment unit 53 may make a judgment by further using the amount of sound characteristics such as an index (for example, an amplitude or energy) indicating the loudness of a sound of a time-series signal, temporal variations in the index indicating the loudness of a sound, a spectral shape, temporal variations in the spectral shape, the interval between pitches, and a fundamental frequency. For example, (1) the judgment unit 53 may make a judgment based on the parameter $\eta_{1,k}$ and the index indicating the loudness of a sound of a time-series signal. Moreover, (2) the judgment unit 53 may make a judgment based on the parameter $\eta_{1,k}$ and the temporal variations in the index indicating the loudness of a sound of a time-series signal. Furthermore, (3) the judgment unit 53 may make a judgment based on the parameter $\eta_{1,k}$ and the spectral shape of a time-series signal. In addition, (4) the judgment unit 53 may make a judgment based on the parameter $\eta_{1,k}$ and the temporal variations in the spectral shape of a time-series signal. Moreover, (5) the judgment unit 53 may make a judgment based on the parameter $\eta_{1,k}$ and the interval between pitches of a time-series signal.

Hereinafter, a description will be made about each of (1) a case in which the judgment unit 53 makes a judgment based on the parameter $\eta_{1,k}$ and the index indicating the loudness of a sound of a time-series signal, (2) a case in which the judgment unit 53 makes a judgment based on the parameter $\eta_{1,k}$ and the temporal variations in the index indicating the loudness of a sound of a time-series signal, (3) a case in which the judgment unit 53 makes a judgment based on the parameter $\eta_{1,k}$ and the spectral shape of a time-series signal, (4) a case in which the judgment unit 53 makes a judgment based on the parameter $\eta_{1,k}$ and the temporal variations in the spectral shape of a time-series signal, and (5) a case in which the judgment unit 53 makes a judgment based on the parameter $\eta_{1,k}$ and the interval between pitches of a time-series signal.

(1) When the judgment unit 53 makes a judgment based on the parameter $\eta_{1,k}$ and the index indicating the loudness of a sound, the judgment unit 53 judges whether or not the index indicating the loudness of a sound of a time-series signal corresponding to the parameter $\eta_{1,k}$ is high and judges whether or not the parameter $\eta_{1,k}$ is large.

If the index indicating the loudness of a sound of a time-series signal is low and the parameter $\eta_{1,k}$ is large, the judgment unit 53 judges that the segment of a time-series signal corresponding to the parameter $\eta_{1,k}$ is the segment of ambient noise (noise).

A judgment as to whether or not the index indicating the loudness of a sound of a time-series signal is high can be made based on a predetermined threshold value $C_E$, for example. That is, the index indicating the loudness of a sound of a time-series signal can be judged to be high if the index indicating the loudness of a sound of a time-series signal≥the predetermined threshold value $C_E$ holds; otherwise, the index indicating the loudness of a sound of a time-series signal can be judged to be low. If, for example, an average amplitude (the square root of average energy per sample) is used as the index indicating the loudness of a sound of a time-series signal, $C_E$=the maximum amplitude value*(1/128) holds. For instance, since the maximum amplitude value is 32768 in the case of 16-bit accuracy, $C_E$=256 holds.

A judgment as to whether or not the parameter $\eta_{1,k}$ is large can be made based on a predetermined threshold value $C_\eta$, for example. That is, the parameter $\eta_{1,k}$ can be judged to be large if the parameter $\eta_{1,k}$≥the predetermined threshold value $C_\eta$ holds; otherwise, the parameter $\eta_{1,k}$ can be judged to be small. For example, $C_\eta$=1 holds.

If the index indicating the loudness of a sound of a time-series signal is low and the parameter $\eta_{1,k}$ is small, the judgment unit 53 judges that the segment of a time-series signal corresponding to the parameter $\eta_{1,k}$ is the segment of a characteristic background sound such as BGM.

If the index indicating the loudness of a sound of a time-series signal is high and the parameter $\eta_{1,k}$ is large, the judgment unit 53 judges that the segment of a time-series signal corresponding to the parameter $\eta_{1,k}$ is the segment of speech or lively music.

If the index indicating the loudness of a sound of a time-series signal is high and the parameter $\eta_{1,k}$ is small, the judgment unit 53 judges that the segment of a time-series signal corresponding to the parameter $\eta_{1,k}$ is the segment of music such as a performance of an musical instrument.

(2) When the judgment unit 53 makes a judgment based on the parameter $\eta_{1,k}$ and the temporal variations in the index indicating the loudness of a sound of a time-series signal, the judgment unit 53 judges whether or not the temporal variations in the index indicating the loudness of a sound of a time-series signal corresponding to the parameter $\eta_{1,k}$ are large and judges whether or not the parameter $\eta_{1,k}$ is large.

A judgment as to whether or not the temporal variations in the index indicating the loudness of a sound of a time-series signal are large can be made based on a predetermined threshold value $C_E'$, for example. That is, the temporal variations in the index indicating the loudness of a sound of a time-series signal can be judged to be large if the temporal variations in the index indicating the loudness of a sound of a time-series signal≥the predetermined threshold value $C_E'$ holds; otherwise, the temporal variations in the index indicating the loudness of a sound of a time-series signal can be judged to be small. If a value F=((1/4)Σ energy of 4 sub-frames)/((Π energy of the sub-frames)$^{1/4}$) which is obtained by dividing the arithmetic mean of energy of 4 sub-frames which make up a time-series signal by the geometric mean thereof is used as the index indicating the loudness of a sound of a time-series signal, $C_E'$=1.5 holds.

If the temporal variations in the index indicating the loudness of a sound of a time-series signal are small and the parameter $\eta_{1,k}$ is large, the judgment unit 53 judges that the segment of a time-series signal corresponding to the parameter $\eta_{1,k}$ is the segment of ambient noise (noise).

If the temporal variations in the index indicating the loudness of a sound of a time-series signal are small and the parameter $\eta_{1,k}$ is small, the judgment unit 53 judges that the segment of a time-series signal corresponding to the parameter $\eta_{1,k}$ is the segment of music of a wind instrument or a stringed instrument which is mainly composed of a continuing sound.

If the temporal variations in the index indicating the loudness of a sound of a time-series signal are large and the parameter $\eta_{1,k}$ is large, the judgment unit 53 judges that the segment of a time-series signal corresponding to the parameter $\eta_{1,k}$ is the segment of speech.

If the temporal variations in the index indicating the loudness of a sound of a time-series signal are large and the parameter $\eta_{1,k}$ is small, the judgment unit 53 judges that the segment of a time-series signal corresponding to the parameter $\eta_{1,k}$ is the segment of music with large time variations.

(3) When the judgment unit 53 makes a judgment based on the parameter $\eta_{1,k}$ and the spectral shape of a time-series signal, the judgment unit 53 judges whether or not the spectral shape of a time-series signal corresponding to the parameter $\eta_{1,k}$ is flat and judges whether or not the parameter $\eta_{1,k}$ is large.

If the spectral shape of a time-series signal is flat and the parameter $\eta_{1,k}$ is large, the judgment unit 53 judges that the segment of a time-series signal corresponding to the parameter $\eta_{1,k}$ is the segment of steady ambient noise (noise). A judgment as to whether or not the spectral shape of a time-series signal corresponding to the parameter $\eta_{1,k}$ is flat can be made based on a predetermined threshold value $E_V$. For instance, the spectral shape of a time-series signal corresponding to the parameter $\eta_{1,k}$ can be judged to be flat if the absolute value of a first-order PARCOR coefficient corresponding to the parameter $\eta_{1,k}$ is smaller than the predetermined threshold value $E_V$ (for example, $E_V$=0.7); otherwise, the spectral shape of a time-series signal corresponding to the parameter $\eta_{1,k}$ can be judged not to be flat.

If the spectral shape of a time-series signal is flat and the parameter $\eta_{1,k}$ is small, the judgment unit 53 judges that the segment of a time-series signal corresponding to the parameter $\eta_{1,k}$ is the segment of music with large time variations.

If the spectral shape of a time-series signal is not flat and the parameter $\eta_{1,k}$ is large, the judgment unit 53 judges that the segment of a time-series signal corresponding to the parameter $\eta_{1,k}$ is the segment of speech.

If the spectral shape of a time-series signal is not flat and the parameter $\eta_{1,k}$ is small, the judgment unit 53 judges that the segment of a time-series signal corresponding to the parameter $\eta_{1,k}$ is the segment of music of a wind instrument or a stringed instrument which is mainly composed of a continuing sound.

(4) When the judgment unit 53 makes a judgment based on the parameter $\eta_{1,k}$ and the temporal variations in the spectral shape of a time-series signal, the judgment unit 53 judges whether or not the temporal variations in the spectral shape of a time-series signal corresponding to the parameter $\eta_{1,k}$ are large and judges whether or not the parameter $\eta_{1,k}$ is large.

A judgment as to whether or not the temporal variations in the spectral shape of a time-series signal corresponding to the parameter $\eta_{1,k}$ are large can be made based on a predetermined threshold value $E_V'$. For instance, the temporal variations in the spectral shape of a time-series signal corresponding to the parameter $\eta_{1,k}$ can be judged to be large if a value $F_V$=((¼)Σ the absolute values of first-order PARCOR coefficients of 4 sub-frames)/((Π the absolute values of the first-order PARCOR coefficients)$^{1/4}$) which is obtained by dividing the arithmetic mean of the absolute values of first-order PARCOR coefficients of 4 sub-frames which make up a time-series signal by the geometric mean thereof is greater than or equal to the predetermined threshold value $E_V'$ (for example, $E_V'$=1.2); otherwise, the temporal variations in the spectral shape of a time-series signal corresponding to the parameter $\eta_{1,k}$ can be judged to be small.

If the temporal variations in the spectral shape of a time-series signal are large and the parameter $\eta_{1,k}$ is large, the judgment unit 53 judges that the segment of a time-series signal corresponding to the parameter $\eta_{1,k}$ is the segment of speech.

If the temporal variations in the spectral shape of a time-series signal are large and the parameter $\eta_{1,k}$ is small, the judgment unit 53 judges that the segment of a time-series signal corresponding to the parameter $\eta_{1,k}$ is the segment of music with large time variations.

If the temporal variations in the spectral shape of a time-series signal are small and the parameter $\eta_{1,k}$ is large, the judgment unit 53 judges that the segment of a time-series signal corresponding to the parameter $\eta_{1,k}$ is the segment of ambient noise (noise).

If the temporal variations in the spectral shape of a time-series signal are small and the parameter $\eta_{1,k}$ is small, the judgment unit 53 judges that the segment of a time-series signal corresponding to the parameter $\eta_{1,k}$ is the segment of music of a wind instrument or a stringed instrument which is mainly composed of a continuing sound.

(5) When the judgment unit 53 makes a judgment based on the parameter $\eta_{1,k}$ and the interval between pitches of a time-series signal, the judgment unit 53 judges whether or not the interval between pitches of a time-series signal corresponding to the parameter $\eta_{1,k}$ is long and judges whether or not the parameter $\eta_{1,k}$ is large.

A judgment as to whether or not the interval between pitches is long can be made based on a predetermined threshold value $C_P$, for example. That is, the interval between pitches can be judged to be long if the interval between pitches≥the predetermined threshold value $C_P$ holds; otherwise, the interval between pitches can be judged to be short. As the interval between pitches, if, for example, a normalized correlation function of sequences separated from each other by a pitch interval τ sample $$R(\tau) = \frac{\sum_{i=\tau}^{N} x(i)x(i-\tau)}{\sum_{i=\tau}^{N} x^2(i)}$$

(where x(i) is a sample value of a time-series and N is the number of samples of a frame) is used, $C_P$=0.8 holds.

If the interval between pitches is long and the parameter $\eta_{1,k}$ is large, the judgment unit 53 judges that the segment of a time-series signal corresponding to the parameter $\eta_{1,k}$ is the segment of speech.

If the interval between pitches is long and the parameter $\eta_{1,k}$ is small, the judgment unit 53 judges that the segment of a time-series signal corresponding to the parameter $\eta_{1,k}$ is the segment of music of a wind instrument or a stringed instrument which is mainly composed of a continuing sound.

If the interval between pitches is short and the parameter $\eta_{1,k}$ is large, the judgment unit 53 judges that the segment of a time-series signal corresponding to the parameter $\eta_{1,k}$ is the segment of ambient noise (noise).

If the interval between pitches is short and the parameter $\eta_{1,k}$ is small, the judgment unit 53 judges that the segment of a time-series signal corresponding to the parameter $\eta_{1,k}$ is the segment of music with large time variations. Furthermore, the judgment unit 53 may make a judgment by using an identification technology such as support vector machine (SVM) or boosting. In this case, learning data correlated with a label such as speech, music, or a pause for each parameter $\eta$ is prepared, and the judgment unit 53 performs learning in advance by using this learning data.

[Programs and Recording Media]

Each unit in each device or each method may be implemented by a computer. In that case, the processing details of each device or each method are described by a program. Then, as a result of this program being executed by the computer, each unit in each device or each method is implemented on the computer.

The program describing the processing details can be recorded on a computer-readable recording medium. As the computer-readable recording medium, for example, any one of a magnetic recording device, an optical disk, a magneto-optical recording medium, semiconductor memory, and so forth may be used.

Moreover, the distribution of this program is performed by, for example, selling, transferring, or lending a portable recording medium such as a DVD or a CD-ROM on which the program is recorded. Furthermore, the program may be distributed by storing the program in a storage device of a server computer and transferring the program to other computers from the server computer via a network.

The computer that executes such a program first, for example, temporarily stores the program recorded on the portable recording medium or the program transferred from the server computer in a storage thereof. Then, at the time of execution of processing, the computer reads the program stored in the storage thereof and executes the processing in accordance with the read program. Moreover, as another embodiment of this program, the computer may read the program directly from the portable recording medium and execute the processing in accordance with the program. Furthermore, every time the program is transferred to the computer from the server computer, the computer may sequentially execute the processing in accordance with the received program. In addition, a configuration may be adopted in which the transfer of a program to the computer from the server computer is not performed and the above-described processing is executed by so-called application service provider (ASP)-type service by which the processing functions are implemented only by an instruction for execution thereof and result acquisition. Incidentally, it is assumed that the program includes information (data or the like which is not a direct command to the computer but has the property of defining the processing of the computer) which is used for processing by an electronic calculator and is equivalent to a program.

Moreover, the devices are assumed to be configured as a result of a predetermined program being executed on the computer, but at least part of these processing details may be implemented on the hardware.

INDUSTRIAL APPLICABILITY

The matching device, method, and program can be used for, for example, retrieving the source of a tune, detecting illegal contents, and retrieving a different tune using a similar musical instrument or having a similar musical construction. Moreover, the judgment device, method, and program can be used for calculating a copyright fee, for example.

What is claimed is:

1. A matching device, wherein on an assumption that a parameter $\eta$ is a positive number and the parameter $\eta$ corresponding to a time-series signal of a predetermined time length is a shape parameter of a generalized Gaussian distribution that approximates a histogram of a whitened spectral sequence which is a sequence obtained by dividing a frequency domain sample sequence corresponding to the time-series signal by a spectral envelope estimated by regarding an $\eta$-th power of an absolute value of the frequency domain sample sequence as a power spectrum, the matching device comprises:

a matching unit that judges, based on a first sequence of the parameters $\eta$ corresponding to each of at least one time-series signal of the predetermined time length which makes up a first signal and a second sequence of the parameters $\eta$ corresponding to each of at least one time-series signal of the predetermined time length which makes up a second signal, a degree of match between the first signal and the second signal and/or whether or not the first signal and the second signal match with each other.

2. The matching device according to claim 1, further comprising:

a parameter determination unit including a spectral envelope estimating unit that estimates, on an assumption that a parameter $\eta_0$ and the parameter $\eta$ are positive numbers, a spectral envelope by regarding an $\eta_0$-th power of an absolute value of a frequency domain sample sequence corresponding to an input time-series signal of a predetermined time length as a power spectrum by using the parameter $\eta_0$ which is set by a predetermined method, a whitened spectral sequence generating unit that obtains a whitened spectral sequence which is a sequence obtained by dividing the frequency domain sample sequence by the spectral envelope, and a parameter obtaining unit that obtains the parameter $\eta$ by which a generalized Gaussian distribution whose shape parameter is the parameter $\eta$ approximates a histogram of the whitened spectral sequence, and uses the parameter $\eta$ thus obtained as the parameter $\eta$ corresponding to the input time-series signal of the predetermined time length, wherein the parameter determination unit obtains the first sequence by performing processing using, as an input, each of the at least one time-series signal of the predetermined time length which makes up the first signal.

3. The matching device according to claim 1 or 2, further comprising:

a second sequence storage in which the second sequence is stored, wherein the matching unit makes the judgment by using the second sequence read from the second sequence storage.

4. The matching device according to claim 1 or 2, wherein the at least one time-series signal of the predetermined time length which makes up the first signal is all or part of time-series signals of the predetermined time length which make up the first signal, and the at least one time-series signal of the predetermined time length which makes up the second signal is all or part of time-series signals of the predetermined time length which make up the second signal.

5. The matching device according to claim 1 or 2, wherein the matching device makes the judgment by using each of a plurality of signals as the second signal.

6. A judgment device, wherein on an assumption that a parameter η is a positive number and the parameter η corresponding to a time-series signal of a predetermined time length is a shape parameter of a generalized Gaussian distribution that approximates a histogram of a whitened spectral sequence which is a sequence obtained by dividing a frequency domain sample sequence corresponding to the time-series signal by a spectral envelope estimated by regarding an η-th power of an absolute value of the frequency domain sample sequence as a power spectrum, the judgment device comprises:

a judgment unit that judges, based on a first sequence of the parameters it corresponding to each of at least one time-series signal of the predetermined time length which makes up a first signal, a segment of a signal of a predetermined type in the first signal and/or a type of the first signal.

7. A non-transitory computer-readable recording medium on which a program for making a computer function as each unit of the matching device according to claim 1 or the judgment device according to claim 6 is recorded.

8. A matching method, wherein on an assumption that a parameter η is a positive number and the parameter n corresponding to a time-series signal of a predetermined time length is a shape parameter of a generalized Gaussian distribution that approximates a histogram of a whitened spectral sequence which is a sequence obtained by dividing a frequency domain sample sequence corresponding to the time-series signal by a spectral envelope estimated by regarding an η-th power of an absolute value of the frequency domain sample sequence as a power spectrum, the matching method comprises:

a matching step in which a matching unit judges, based on a first sequence of the parameters η corresponding to each of at least one time-series signal of the predetermined time length which makes up a first signal and a second sequence of the parameters η corresponding to each of at least one time-series signal of the predetermined time length which makes up a second signal, a degree of match between the first signal and the second signal and/or whether or not the first signal and the second signal match with each other.

9. A judgment method, wherein on an assumption that a parameter ii is a positive number and the parameter η corresponding to a time-series signal of a predetermined time length is a shape parameter of a generalized Gaussian distribution that approximates a histogram of a whitened spectral sequence which is a sequence obtained by dividing a frequency domain sample sequence corresponding to the time-series signal by a spectral envelope estimated by regarding an η-th power of an absolute value of the frequency domain sample sequence as a power spectrum, the judgment method comprises:

a judgment step in which a judgment unit judges, based on a first sequence of the parameters η corresponding to each of at least one time-series signal of the predetermined time length which makes up a first signal, a segment of a signal of a predetermined type in the first signal and/or a type of the first signal.

* * * * *